US008214944B2

(12) United States Patent
Patterson

(10) Patent No.: US 8,214,944 B2
(45) **Date of Patent: *Jul. 10, 2012**

(54) PATIENT LIFT AND TRANSFER DEVICE

(75) Inventor: Richard A. Patterson, Georgetown, TX (US)

(73) Assignee: ConMediSys, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/180,415

(22) Filed: Jul. 11, 2011

(65) Prior Publication Data

US 2011/0265259 A1 Nov. 3, 2011

Related U.S. Application Data

(63) Continuation of application No. 12/566,577, filed on Sep. 24, 2009, now Pat. No. 7,975,329, which is a continuation of application No. 11/246,426, filed on Oct. 7, 2005, now Pat. No. 7,603,729.

(51) Int. Cl.
*A61G 7/00* (2006.01)

(52) U.S. Cl. ..... 5/81.1 C; 5/81.1 HS

(58) Field of Classification Search ..... 5/81.1 R, 5/81.1 C, 81.1 HS; 198/321, 312, 300, 318, 198/817, 812; 414/921
See application file for complete search history.

(56) References Cited

U.S. PATENT DOCUMENTS

| | | | |
|---|---|---|---|
| 2,480,737 | A | 8/1949 | Jayle |
| 2,528,048 | A | 10/1950 | Gilleland |
| 3,213,882 | A | 10/1965 | Beatty |
| 3,418,670 | A | 12/1968 | Morgan |
| 3,593,351 | A | 7/1971 | Dove |
| RE28,056 | E | 6/1974 | Stevens |
| 3,871,036 | A | 3/1975 | Attenburrow |
| 3,947,902 | A | 4/1976 | Conde et al. |
| 3,967,328 | A | 7/1976 | Cox |
| 4,019,772 | A | 4/1977 | Lee |
| 4,073,016 | A | 2/1978 | Koll |
| 4,077,073 | A | 3/1978 | Koll et al. |

(Continued)

FOREIGN PATENT DOCUMENTS

DE 10023729 1/2002

(Continued)

OTHER PUBLICATIONS

MLA AT-2000 Patient Transfer System [online], from the Internet URL: http://www.ssl.gb.com/knight/mla_stretchairs.htm (2003).

(Continued)

*Primary Examiner* — William Kelleher
(74) *Attorney, Agent, or Firm* — Jack V. Musgrove

(57) ABSTRACT

A transfer device has a carriage supported on a base, movable between a home position and an extended position. A table assembly includes a lower table fixed to the carriage and an upper table coupled to the lower table, movable between a downward position in forcible contact with the lower table and an upward position having no contact with the lower table. The table assembly moves toward the extended position with the tables in forcible contact to place the table assembly underneath the object to be transferred while keeping the base stationary. The plates are separated to lift the object on the upper table while the lower table remains resting upon the support surface. The table assembly returns to the home position while supporting the object on the upper table and keeping the upper and lower tables separated. The device may operate in a bidirectional manner.

9 Claims, 9 Drawing Sheets

U.S. PATENT DOCUMENTS

| | | | |
|---|---|---|---|
| 4,087,873 | A | 5/1978 | Ohkawa |
| 4,248,444 | A | 2/1981 | Johnson |
| 4,297,753 | A | 11/1981 | Langren |
| 4,300,782 | A | 11/1981 | Pioth |
| 4,631,761 | A | 12/1986 | Lederman |
| 4,646,860 | A | 3/1987 | Owens et al. |
| 4,669,137 | A | 6/1987 | Schnelle et al. |
| 4,747,170 | A | 5/1988 | Knouse |
| 4,761,841 | A | 8/1988 | Larsen |
| 4,794,655 | A | 1/1989 | Ooka et al. |
| 4,803,744 | A | 2/1989 | Peck et al. |
| 4,839,933 | A | 6/1989 | Plewright et al. |
| 4,868,938 | A | 9/1989 | Knouse |
| 4,914,769 | A | 4/1990 | Kume et al. |
| 4,922,574 | A | 5/1990 | Heiligenthal et al. |
| 4,987,623 | A | 1/1991 | Stryker et al. |
| 5,048,133 | A | 9/1991 | Iura et al. |
| 5,069,465 | A | 12/1991 | Stryker et al. |
| 5,163,189 | A | 11/1992 | DeGray |
| 5,185,894 | A | 2/1993 | Bastert et al. |
| 5,238,350 | A | 8/1993 | Krieg et al. |
| 5,257,425 | A | 11/1993 | Shinabarger |
| 5,335,651 | A | 8/1994 | Foster et al. |
| 5,428,851 | A | 7/1995 | Shore et al. |
| 5,522,100 | A | 6/1996 | Schilling et al. |
| 5,540,321 | A | 7/1996 | Foster |
| 5,737,781 | A | 4/1998 | Votel |
| 5,771,513 | A | 6/1998 | Kirchgeorg et al. |
| 5,850,642 | A | 12/1998 | Foster |
| 5,890,238 | A | 4/1999 | Votel |
| 5,937,456 | A | 8/1999 | Norris |
| 6,314,597 | B2 | 11/2001 | Heimbrock et al. |
| 6,374,435 | B1 | 4/2002 | Leininger et al. |
| 6,438,776 | B2 | 8/2002 | Ferrand et al. |
| 6,598,247 | B1 | 7/2003 | Helmbrock et al. |
| 6,698,041 | B2 | 3/2004 | VanSteenburg et al. |
| 6,735,794 | B1 | 5/2004 | Way et al. |
| 6,792,630 | B1 | 9/2004 | Palmatier et al. |
| 6,857,143 | B2 | 2/2005 | McNulty |
| 6,932,209 | B2 | 8/2005 | Kasagami et al. |
| 7,000,268 | B2 | 2/2006 | Johnson |
| 7,200,881 | B2 | 4/2007 | Kasagami et al. |
| 7,210,176 | B2 | 5/2007 | Weedling et al. |
| 7,540,044 | B2 | 6/2009 | Patterson et al. |
| 2003/0182723 | A1 | 10/2003 | Kasagami et al. |
| 2005/0066442 | A1 | 3/2005 | Kasagami et al. |
| 2007/0074343 | A1 | 4/2007 | McNulty |

FOREIGN PATENT DOCUMENTS

| | | |
|---|---|---|
| JP | 1230357 | 9/1989 |
| JP | 8224273 | 9/1996 |
| JP | 2001104378 | 4/2001 |

OTHER PUBLICATIONS

Linkage Mechanism Simulator [online], retrieved on Dec. 21, 2008 from the Internet URL: http://www.edu-ctr.pref.kanagawa.jp/LinkWeb/index_e.htm.

PATIENT LIFT AND TRANSFER DEVICE

CROSS-REFERENCE TO RELATED APPLICATION

This application is a continuation of U.S. patent application Ser. No. 12/566,577 filed Sep. 24, 2009 now U.S. Pat. No. 7,975,329, which is a continuation of U.S. patent application Ser. No. 11/246,426 filed Oct. 7, 2005, now U.S. Pat. No. 7,603,729.

BACKGROUND OF THE INVENTION

1. Field of the Invention

The present invention generally relates to devices for moving objects, and more specifically to a method and device for transferring mobility-impaired persons, such as moving a patient from a bed to a table.

2. Description of the Related Art

A wide variety of products have been designed to move objects from one location to another and, in particular, transfer mobility-impaired individuals such as patients. In a hospital setting, patients must often be transported from their beds to an examination table or operating table, and back again. Basic devices for transferring patients include stretchers that are carried manually by two attendants, and wheeled gurneys that can more easily be handled by a single attendant.

There can still be problems, however, in getting a patient from a bed or other support surface onto a stretcher or gurney. If the patient is cooperative and not injured or disabled, it is a simple matter for the individual to slide over to the gurney with the assistance of a nurse, but if the patient is unconscious or has a disability or an injury (e.g., a broken bone) that might be worsened by movement, then great care must be taken in transferring the patient from the bed to the gurney. This problem is exacerbated when the patient is unusually heavy.

One solution to this problem is to slide a tray or sheet under the person and then, after the person is resting atop it, pull the tray or sheet off the bed and onto the gurney. A rigid tray can be forcibly inserted between the patient and the bed, and a sheet can be incrementally pushed under the person by first rocking him away from the gurney and then rocking back toward the gurney as the sheet is drawn under. This approach can still be difficult if the patient is uncooperative, and can further be very uncomfortable even if the patient is cooperative, due to the frictional engagement of the tray with the body or the lack of firm support by the sheet.

Some transfer devices incorporate a rigid tray into the gurney that can move to the side and slide under a patient, and then slide back (while supporting the patient) to a centered position for transportation. In a further variation on this concept, the transfer device may use counter-rotating, endless belts to substantially eliminate friction against both the patient and the bed as support trays crawl under the patient. One example of such a design is shown in U.S. Pat. No. 5,540,321. A first endless belt surrounds a set of upper trays and a second endless belt surrounds a set of lower trays, so the portions of the belts that are in contact (between the upper and lower tray sets) move in the same direction at the same rate as they counter-rotate. As the trays are inserted under the patient, the belt on the upper tray everts outwardly at the same rate as the translational movement of the trays to crawl under the patient without introducing any significant friction, and the belt on the lower tray similarly everts along the bed sheet. Once the patient is supported by the trays, the entire tray assembly is raised off the bed and the device can be rolled on casters to transport the patient.

There are still several serious problems with the counter-rotating belt designs. The entire transfer device (including the base and support members) moves as the trays are inserted under the patient, and the base must extend under the bed or table in order to prevent the device from tipping over when the patient is carried (see, e.g., FIG. 10 of '321 patent). Because of this limitation, such devices cannot be used in all settings, i.e., wherein there is insufficient clearance space under the bed or table (a situation becoming more common as more accouterments are added to beds and tables that occupy the space underneath). These devices further only allow loading and unloading along one side of the device, which can present problems when the patient is not suitably oriented (head-to-feet) on the device with respect to the bed or table. Designs such as that shown in the '321 patent are also not particularly comfortable as there is only a thin layer of the belt interposed between the patient and the hard surface of the metal support trays. Moreover, hospitals are becoming increasingly concerned with potential contamination from patient fluids, and the prior art belt-type transfer devices are difficult if not impossible to properly clean.

In light of the foregoing, it would be desirable to devise an improved patient transfer device that provided more flexibility in deployment while still being easy to operate and maneuver. It would be further advantageous if the device were more comfortable for the patient.

SUMMARY OF THE INVENTION

It is therefore one object of the present invention to provide an improved method and device for transporting an object such as a patient from one location to another.

It is another object of the present invention to provide such a patient transfer device that does not require clearance space under the patient's bed or table during operation.

The foregoing objects are achieved in a transfer device generally comprising a base having at least one support member, a carriage member attached to the support member movable between a home position over the base and an extended position to a side of the base, and a table assembly having a lower table member fixed to the carriage member and an upper table member coupled to the lower table member movable between a downward position wherein said upper table member is in forcible contact with said lower table member and an upward position wherein said upper table member has no contact with said lower table member. The device is operated by positioning the base adjacent the object support surface (e.g., a bed or table), adjusting a height of the table assembly to a height of the support surface, moving the table assembly toward the extended position with the upper and lower tables in forcible contact to place the table assembly underneath the object but resting upon the support surface while keeping the base stationary, separating the upper and lower tables with the table assembly in the extended position to lift the object above the support surface on the upper table while the lower table remains resting upon the support surface, and moving the table assembly back toward the home position while supporting the object on the upper table and keeping the upper and lower tables separated. The device may operate in a bidirectional manner wherein the extended position is a first extended position to a first side of the base, and the table assembly is further movable toward a second extended position to a second side of the base opposite the first side while supporting the object on the upper table and keeping the upper and lower tables separated. In the exemplary embodiment, the upper table includes an upper plate surrounded by a first belt, the lower table includes a lower plate surrounded by a second belt, and the first and second belts counter-rotate against each other as the table assembly is moved toward the extended position with the upper and lower tables in forcible contact. The table assembly is advantageously synchronized to move to or from the home position at a speed that matches an eversion rate of the counter-rotating belts. The upper and lower plates are preferably separable by a distance of at least 1 to 2 inches in order to facilitate cleaning of the belt surfaces. A pad may be inserted between the upper plate and the top belt to provide more comfort to the patient during transfer and reduce pressure sores. A low-friction layer is preferably interposed between the pad and the top belt.

The above as well as additional objectives, features, and advantages of the present invention will become apparent in the following detailed written description.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DESCRIPTION OF THE PREFERRED EMBODIMENT(S)

Figure 1:
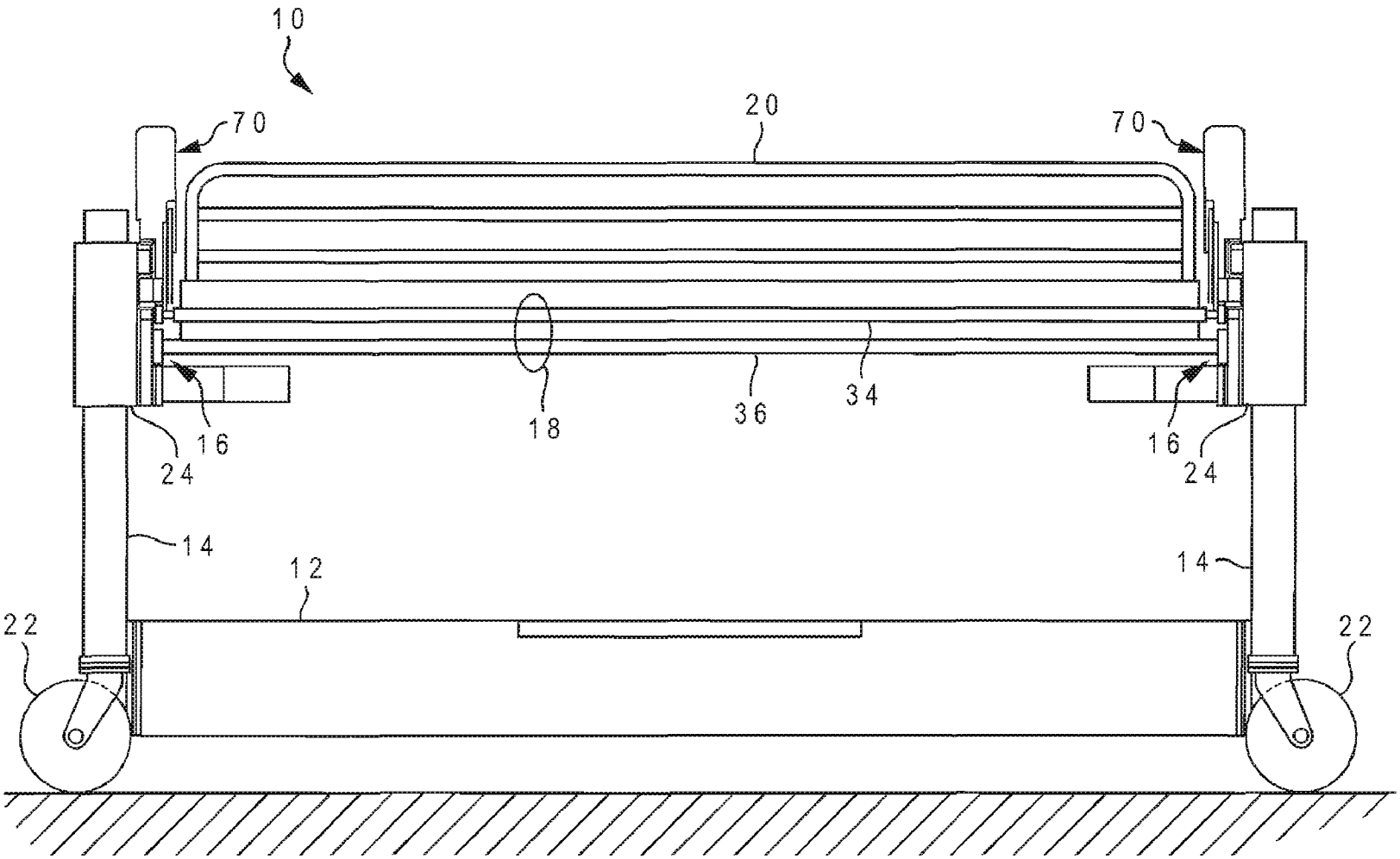
FIG. 1 is a side elevational view of one embodiment of a patient lift and transfer device constructed in accordance with the present invention.
Figure 2:
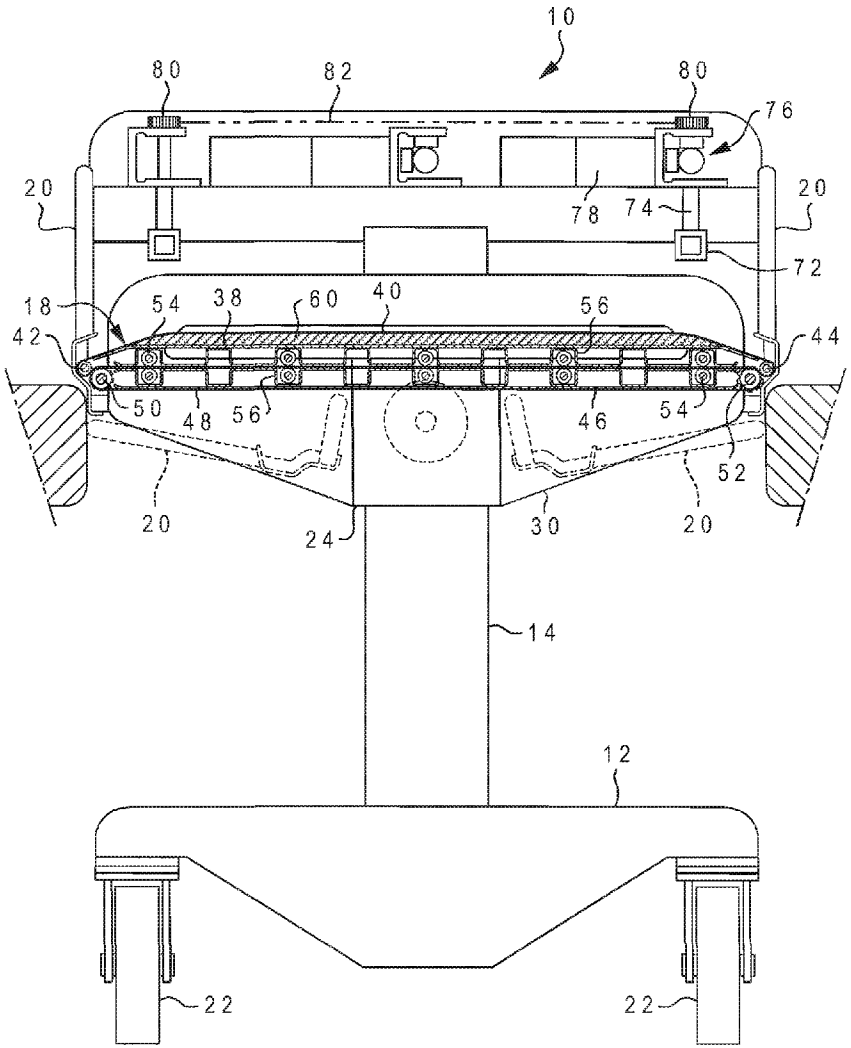
FIG. 2 is a front elevational view of the patient lift and transfer device of FIG. 1.
Figure 3:
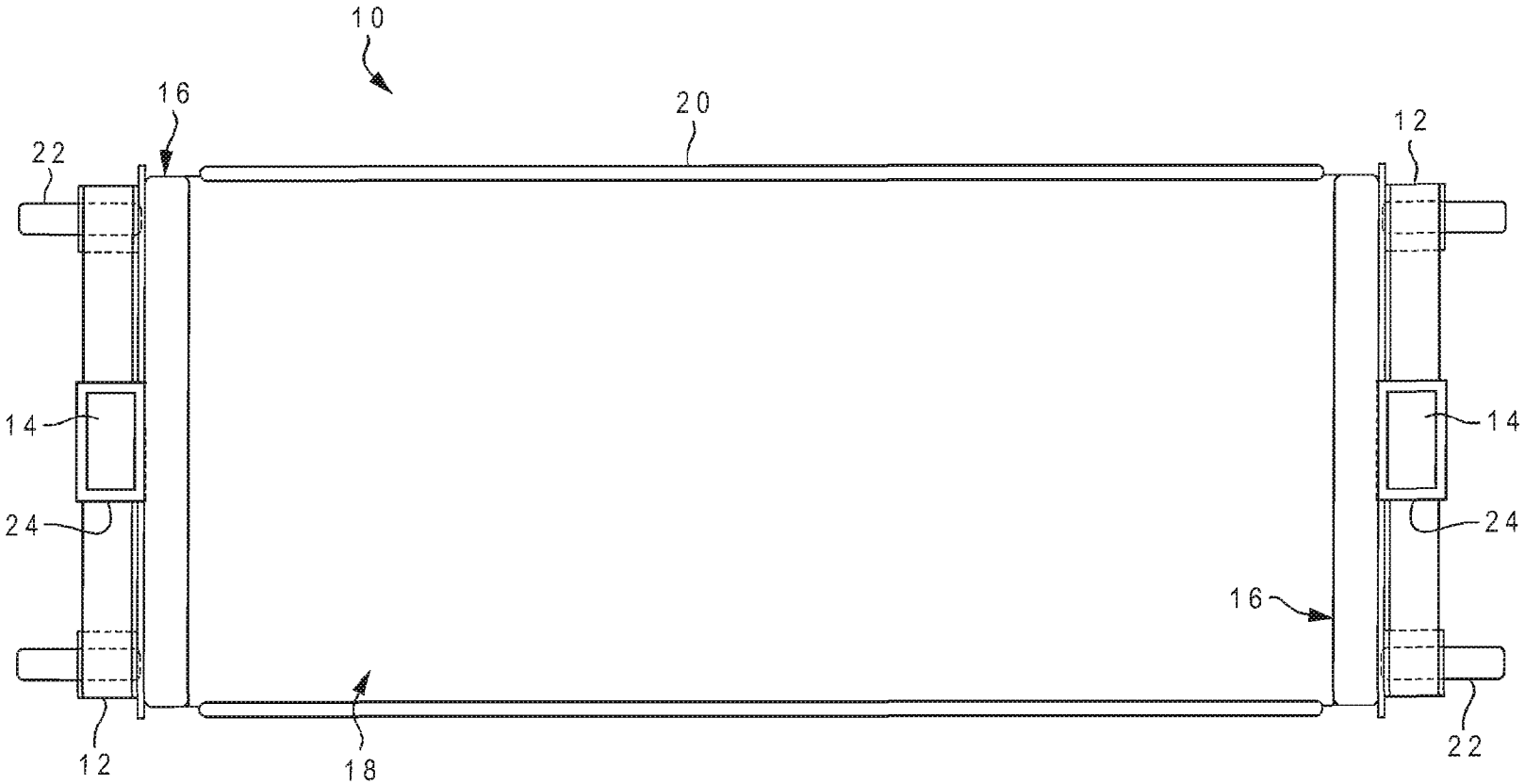
FIG. 3 is a top plan view of the patient lift and transfer device of FIG. 1.

With reference now to the figures, and in particular with reference to FIGS. 1-3, there is depicted one embodiment 10 of a patient lift and transfer device constructed in accordance with the present invention. Patient lift and transfer device 10 is generally comprised of a frame or base 12, two vertical support columns 14 mounted on base 12, a horizontal slide assembly 16 attached to support columns 14, a table assembly 18 attached to slide assembly 16, and side rails 20 attached to support columns 14.

Base 12 is generally rectangular in shape when viewed from above, and extends the full length of device 10. Base 12 is constructed of any durable material, preferably a fairly dense metal or metal alloy such as stainless steel to help anchor the device. Four wheels or pivoting casters 22 are attached to base 12, one at each corner, and provide a clearance space of about three inches between the bottom of base 12 and the floor. Casters 22 are preferably large-diameter, low-rolling resistance and have locking mechanisms or brakes to keep base 12 stationary during a loading or unloading operation. Alternately, it may be desirable to lower four locking posts (having rubber feet and located at each corner) down onto the floor from base 12, slightly lifting the wheels off the floor; the posts then rigidly hold the unit in position during lifts and transfers. The rear wheels may be fixed with only front casters to facilitate pushing device 10 in a manner similar to a grocery cart. A suspension system can optionally be installed between the base and the wheels for smoother transportation of the patient.

Support columns 14 are tubular members rectangular in cross-section, and are preferably constructed of stainless steel. Support columns 14 may be mounted on base 12 by inserting the lower ends into mating sockets of base 12 and securing them using fasteners such as bolts or by welding. The effective height of support columns 14 is adjustable, by using vertically sliding or telescoping sleeves 24 that surround the upper portions of columns 14. Sleeves 24 may be coupled to columns 14 by lead screws or interlocking slide structures that may be actuated by a foot pedal to selectively raise and lower the sleeves. The power distribution system from the foot pedal may be mechanical, hydraulic, or a combination thereof. Alternatively, an electric motor can be used to power the movement of sleeves 24, and a rechargeable electric battery can be stored within a compartment of base 12, with a switch or dial to control the electric motor.

Side rails 20 are positioned in a vertical orientation along the left and right sides of patient lift and transfer device 10 after the patient has been loaded, to prevent the patient from rolling or sliding off during transportation. Side rails 20 can be stowed underneath table assembly 18 during a loading or unloading operation. The side rails are releasably locked into either of these two positions using underside tabs or clips that latch onto detents formed on the support columns.

Figure 4:
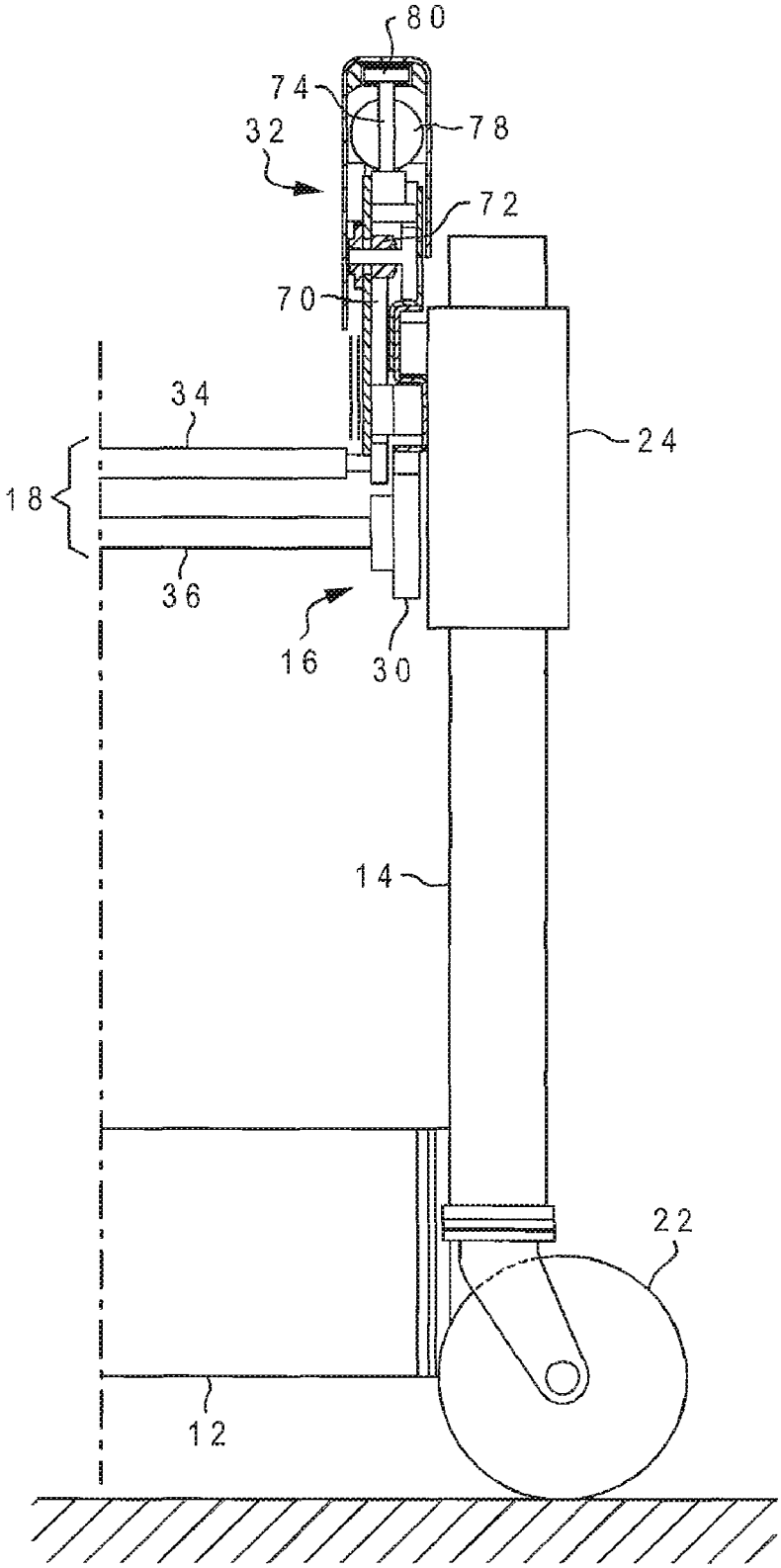
FIG. 4 is a side elevational view of one of the adjustable support members and a lift mechanism for the patient lift and transfer device of FIG. 1.

FIG. 4 illustrates in further detail how table assembly 18 is attached to slide assembly 16, and how slide assembly 16 is attached to support columns 14. Slide assembly 16 includes two slide frames 30 fixed at each end of device 10 (head and foot) to respective support column sleeves 24, and two carriages 32 that slide within bearing tracks of slide frame 30 similar to a sliding desk drawer. Slide frames 30 are preferably constructed of stainless steel and are affixed to sleeves 24 by fasteners or welding. Carriages 32 may also be constructed of stainless steel. Carriages 32 are members that are free to slide within frames 30 to either the left side or right side of the unit.

Figure 5:
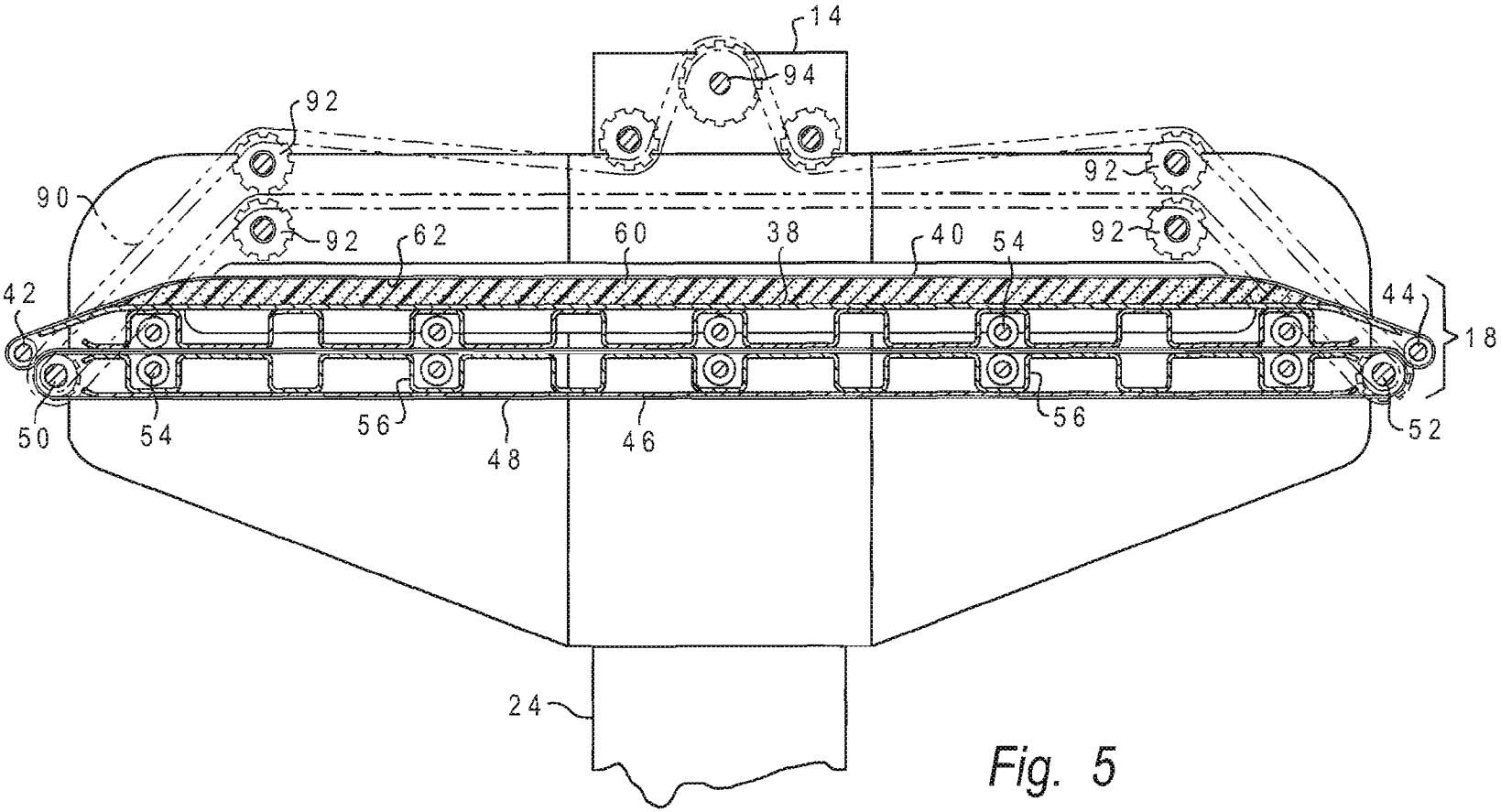
FIG. 5 is a front elevational view of the patient lift and transfer device of FIG. 1 depicting internal details of the upper and lower support plates and belt drive mechanism.

Table assembly 18 includes an upper table portion 34 and a lower table portion 36. As seen in FIGS. 2 and 5, upper table portion 34 includes an upper plate 38 surrounded by a first endless belt 40, and small diameter idler rollers 42, 44 inside the belt along both lengthwise edges of the plate. Lower table portion 36 includes a lower plate 46 surrounded by a second endless belt 48, and larger diameter drive rollers 50, 52 inside the belt along both lengthwise edges of the plate. The span between idler rollers 42, 44 is wider than the span between drive rollers 50, 52, i.e., each lengthwise edge of upper table portion 34 slightly overlaps the corresponding lengthwise edge of lower table portion 36 when the table assembly is in its centered (home) position. The belts do not need to completely surround the plates across their full length, but the width of the belts preferably extends substantially the full length of the table assembly members.

Upper and lower plates 38, 46 are preferably formed from corrugated sheets of rigid metal such as stainless steel, whereby alternating grooves and ridges form discontinuous upper and lower surfaces for each plate 38, 46. Opposing rollers or platens 54 are disposed within every other groove 56 of the corrugations, and serve to forcibly press the bottom leg of top belt 40 against the top leg of bottom belt 48 when upper table portion 34 is in contact with lower table portion 36. The platens also help distribute the load of the patient lying on the top surface to the lower support plate structure.

A foam pad 60 that is generally the same size as upper plate 38 is positioned between the underside of the top leg of top belt 40 and the upper surface of upper plate 38. The lengthwise edges of foam pad 60 are tapered to allow top belt 40 to more easily move from one set of edge rollers over the top surface of foam pad 60, and back to the opposite set of edge rollers. Foam pad 60 generally makes the unit more comfortable for the patient during transportation, and prevents pressure sores from being created when patients are resting on the device for extended periods. In the exemplary embodiment pad 60 polyurethane foam about 0.75 inches thick, and the lengthwise edges of the foam are tapered on one side only, from a thickness of about 0.12 inches at the edge to full thickness approximately 5 to 6 inches in from the edges. Instead of a foam pad, the pad could be an air mattress, water-filled bladder, etc.

To further facilitate the movement of top belt 40 along foam pad 60, a thin layer 62 of low-friction material can be used to cover foam pad 60, i.e., to contact the underside surface of the top leg of top belt 40. Low-friction layer 62 may be a fabric-reinforced Teflon (polytetrafluoroethylene) sheet that is anchored beyond the tapered edges of the foam pad at the edges of upper plate 38, and extends across the complete width and length of foam pad 60. The edges of the sheet can be secured by fasteners, adhesives, or crimping the edges of plate 38. This design of upper table portion 34 could serve as a separate (manual) transfer table.

Belts 40 and 48 may be formed as true endless belts or with a joining seam (overlapping without adding extra thickness), and are constructed of any durable, flexible material such as fabric-reinforced polyvinyl chloride (PVC) elastomer. Each belt preferably has a thickness in the range of 0.03 to 0.04 inches and is as wide as the overall length of patient lift and transfer device 10. Bottom belt 48 may have small cross-sectional V-shaped guiding/driving strips located every foot on the inside of belt 48, and top belt 40 may have smaller V-shaped strips every two feet. The outside surfaces of the belts provide a high coefficient of friction with the bed or patient (for example, using PVC or ethyl vinyl acetate (EVA)), and the inside surfaces of the belts has a coating made from a low-friction material such as Teflon.

Returning to FIG. 4, the axles of drive rollers 50, 52 and the platens 54 within lower table portion 36, and lower plate 46, are all attached at their lengthwise ends to carriages 32. Lower table portion 36 accordingly moves vertically with the movement of sleeves 24. The axles of idler rollers 42, 44 and the platens 54 within upper table portion 34, and upper plate 38, are all attached at their lengthwise ends to four vertical plate separators 70, one at each corner of device 10. Each vertical plate separator 70 is affixed to carriage 32, so the vertical plate separators also move vertically with the movement of sleeves 24. Vertical plate separators 70 include short screw jack assemblies each consisting of a nut 72 attached to one of the corners of upper plate 38, and a lead screw 74 that engages nut 72 and is attached to carriage 32. A right-angle gear box 76 transmits power to lead screw 74 through a horizontally-oriented gear motor 78. Motors 78 are used to directly drive one of the two lead screws at a given end of device 10, and the second lead screw at that end is driven from the first lead screw via a pair of sprockets 80 and a drive chain 82. The vertical plate separators act to separate upper table portion 34 from lower table portion 36 by at least 1 to 2 inches. When the table portions are separated, there is slack in top belt 40, but the separation distance is still sufficient to remove any contact between the sagging portion of the top belt and the top leg of bottom belt 48.

An exemplary drive mechanism for the belts is depicted in FIG. 5. One end of each axle of drive rollers 50 and 52 has teeth or a gear which engages a drive chain 90. Drive chain 90 is supported under tension by several idler sprockets 92 and a drive shaft 94. Idler sprockets 92 and drive shaft 94 are rotatably mounted on an extension of carriage 32, such that the drive mechanism moves vertically with the movement of sleeve 24 and further moves to one side of the unit as table assembly 18 is positioned on that side. Idler sprockets 92, drive shaft 94, and rollers 42, 44, 50, and 52 can rotate clockwise or counter-clockwise. When upper table portion 34 is in forcible contact with lower table portion, movement of bottom belt 48 via drive chain 90 in either direction will in turn drive top belt 40 through the frictional engagement of the belts' outside surfaces. When upper table portion 34 is in the raised position with respect to lower table portion 36, the belts will not be in contact so driving bottom belt 48 will not move top belt 40.

A rack and pinion mechanism may be used to drive the horizontal (sideways) movement of carriage 32 and table assembly 18 between the home and extended (left/right) positions. A rack is affixed to each carriage 32 with the length of the rack extending along the direction of the sliding movement of carriage 32. A drive pinion is mounted to each slide frame 30 and engages the teeth of the adjacent rack. The movement of slide assembly 16 is synchronized with the belt drive mechanism illustrated in FIG. 5, so that carriage 32 slides sideways to or from the home position at a speed that matches the eversion rate of belts 40 and 48. This synchronization may be accomplished using stepper motors whose movement is monitored and controlled by sensors in the motors, or by a mechanical coupling. In this manner, table assembly 18 can crawl under (or away from) the patient with essentially no frictional engagement between the patient and top belt 40 or between the bed/table and bottom belt 48, and further performs this operation without requiring that base 12 also move sideways.

Vertical plate separator 70, drive shaft 94 and drive pinions 102 may all be powered via the same foot pedal that is used to raise and lower sleeve 24, by providing mechanical means (gears, shafts, sprockets, levers, cams, latches, etc.) and/or hydraulic means (pumps, piston cylinders, motors, valves, rigid or flexible tubing, etc.) with manually operated switches that allow the operator to select the movement mode and apply the power system to the desired drive mechanisms. Alternatively, two or more foot pedals can be employed to power the following four motions: linear vertical motion to raise and lower the table assembly to the height of a bed from which a patient is to be transferred; rotary motion to extend and retract the belt table to the right side or left side during placement or removal of a patient from a bed; rotary motion to drive the bottom belt on the belt table clockwise or counter-clockwise; and linear or rotary motion to raise and lower the upper table portion with respect to the lower table portion. The foot pedals are preferably located in a recess of base 12 so as to prevent damage to the pedals if the unit slams against a wall or other object. Instead of foot pedals, power can be supplied by one or more electric motors with a portable power supply and controls.

The moving parts of device 10 can be limited by safety interlocks to prevent an operator from ever transferring a patient to a position on or adjacent the device that would endanger the patient's safety. Safety interlocks can be used to prevent: horizontal or vertical table motion unless the casters/wheels are locked against rotating or other means have been deployed to prevent movement of the base; horizontal (sideways) motion of the table assembly or slide assembly unless sensors indicate that there is sufficient pressure against the bed mattress or other support surface; rotation of the belts unless these sensors are active; movement of the casters/wheels (or retraction of locking posts) unless the table assembly (or sleeve 24) is below a prescribed height to reduce top heaviness while the device is functioning as a gurney.

Figure 6:
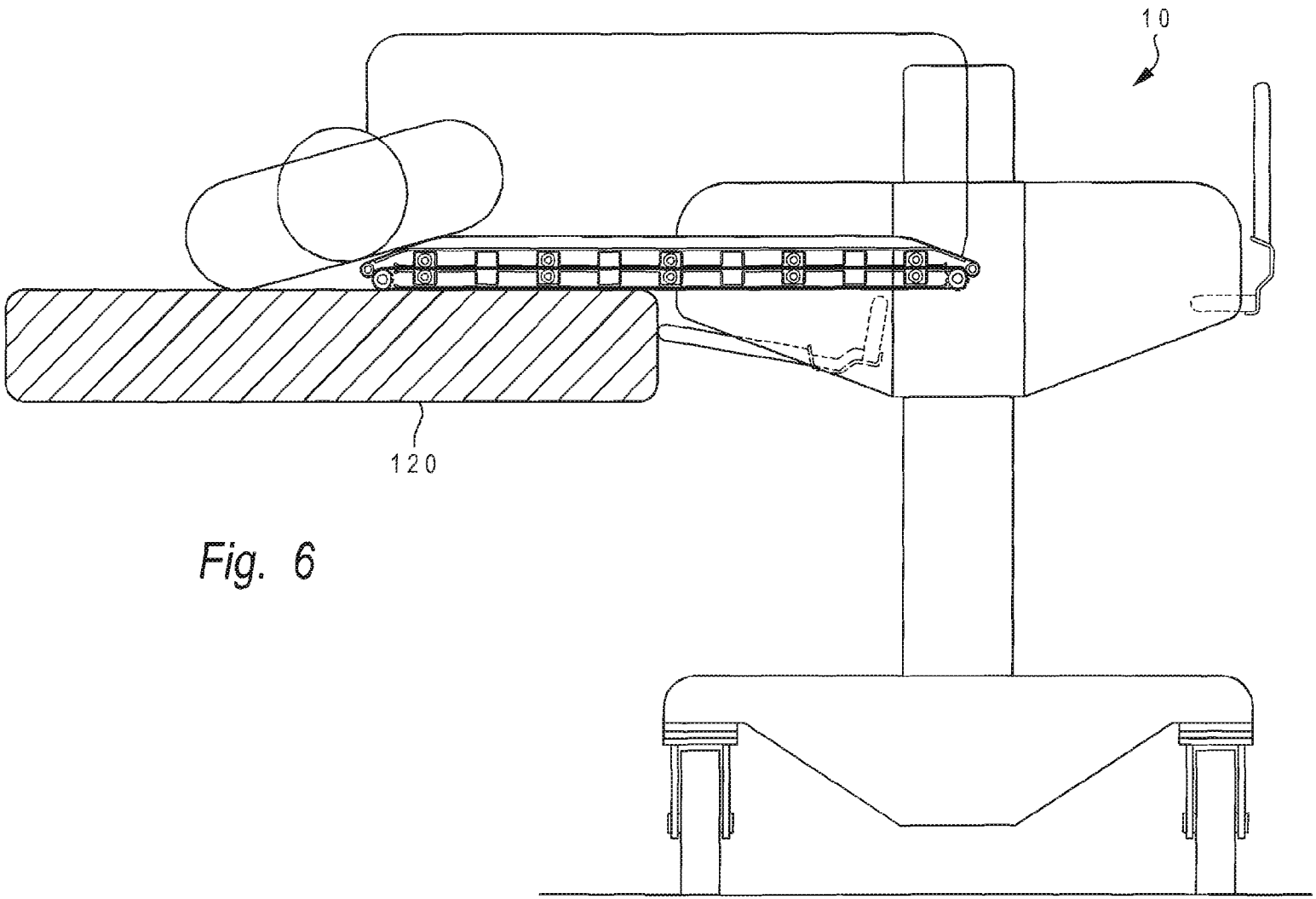
FIG. 6 is a front elevational view of the patient lift and transfer device of FIG. 1 illustrating initial placement of the support plates under a patient to be transferred.
Figure 7:
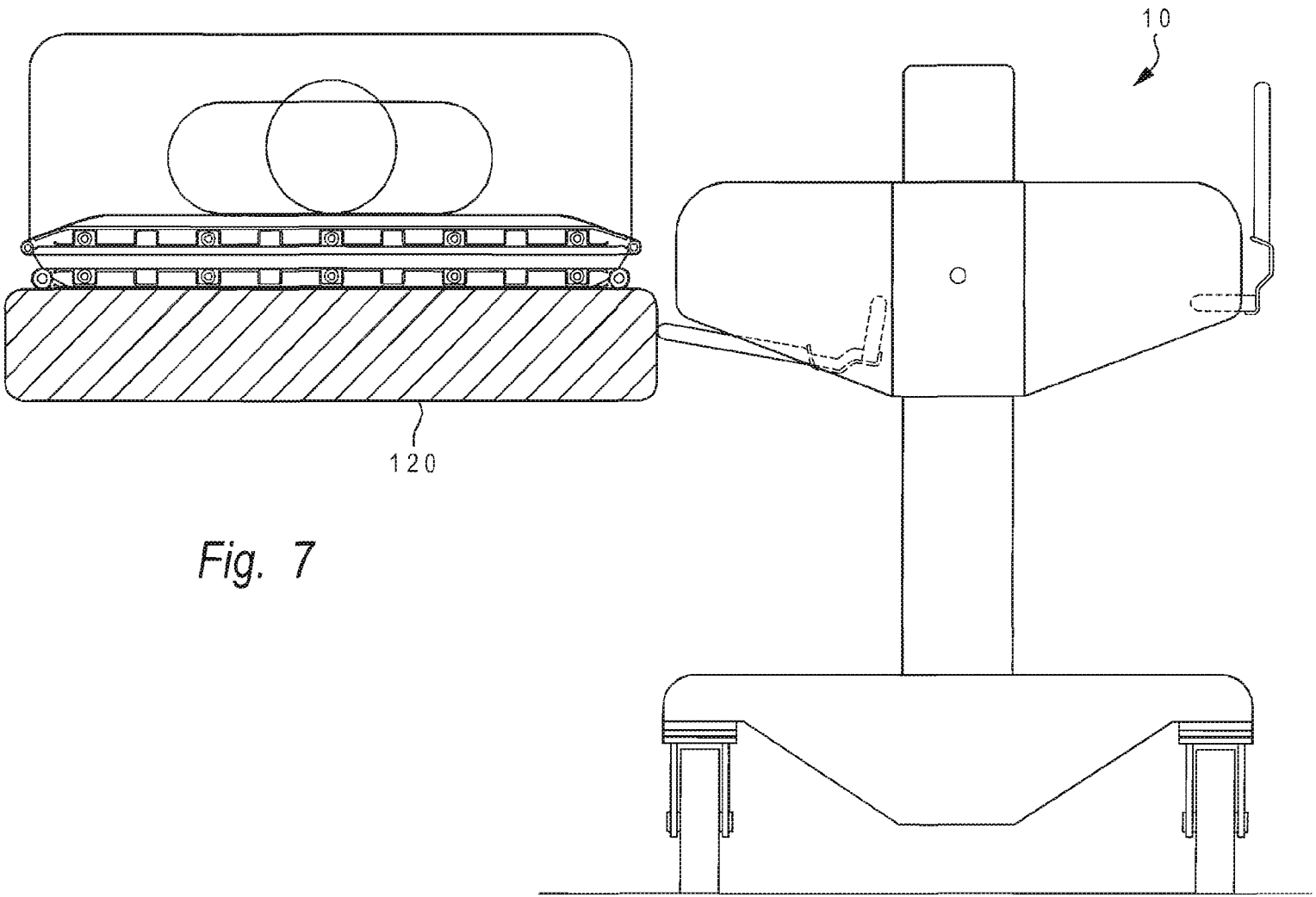
FIG. 7 is a front elevational view of the patient lift and transfer device of FIG. 1 illustrating lifting of the patient and separation of the upper and lower support plates.
Figure 8:
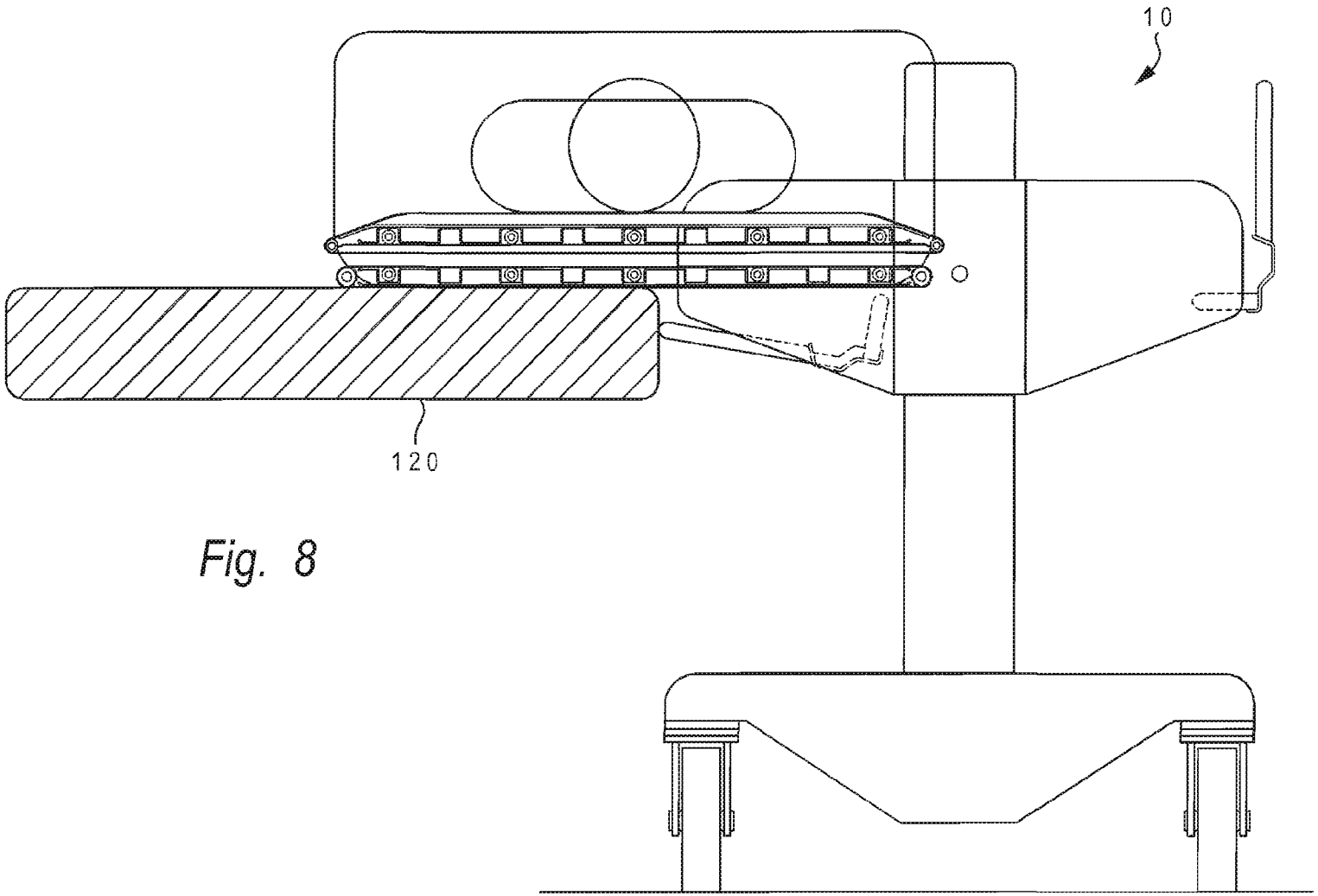
FIG. 8 is a front elevational view of the patient lift and transfer device of FIG. 1 illustrating a home position of the support plates for transporting the patient.
Figure 9:
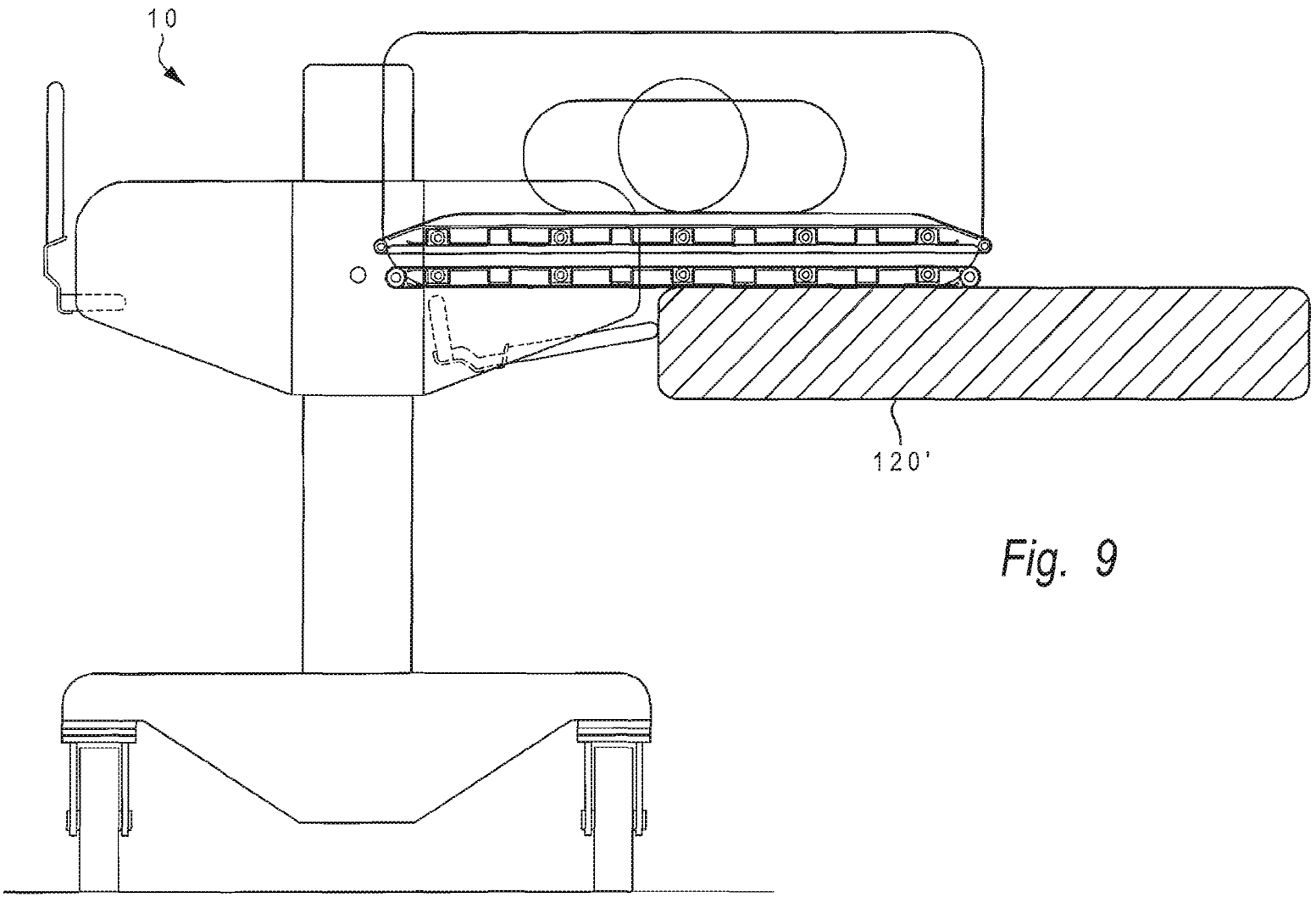
FIG. 9 is a front elevational view of the patient lift and transfer device of FIG. 1 illustrating the transfer of the patient to the opposite side of the device.

The present invention may be further understood with reference to FIGS. 6-9 which illustrate the loading and unloading of a patient using lift and transfer device 10. In FIG. 6, device 10 has been positioned adjacent a hospital bed or table 120, and slide assembly 16 is partially extended, with upper and lower table portions 34 and 36 in contact with one another, and the leading edge of table assembly 18 just starting to crawl under the patient. The device may be used whether the patient is supine or prone. In FIG. 7, table assembly 18 has been moved fully under the patient, and the upper and lower table portions have been separated. The moment force from the patient acting on the device is transferred from upper table portion 34 to lower table portion 36 by means of their coupling through vertical plate separator 70 and carriage 32, so that lower table portion 36 laterally supports the device. Slide assembly 16 and table assembly 18 can then be moved back toward the home position as shown in FIG. 8. Top belt 40 is stationary as the patient is transferred to or from the home position since the table portions are still separated, and the leading edge of lower table portion 36 continues to support the device as long as it rests on the mattress of bed 120. Once these assemblies have returned to the home position (substantially centered over base 12), the patient can be transported to another location using device 10 as a gurney. FIG. 9 depicts offloading of the patient on the opposite side of device 10 to another bed or table 120', i.e., patient lift and transfer device 10 is bidirectional. In this embodiment the construction and movement of slide assembly 16, table assembly 18, and their drive mechanisms are generally symmetric along a common lengthwise axis of the upper and lower table portions.

By utilizing a slide assembly that moves the support table under the patient without having to move the base of the unit, patient lift and transfer device 10 advantageously becomes usable in those situations where there is little or no clearance space under the bed or table. Many prior art devices require part of the base to extend under the bed/table in order to prevent the device from tipping over once the patient has been loaded onto a support surface. The present invention eliminates this concern by allowing the upper and lower table portions to separate, which enables the lower table portion to laterally support the device while the entire table assembly is returning to the home position. Furthermore, this design still takes advantage of counter-rotating belts to reduce frictional engagement while loading or unloading, but leaves the patient undisturbed on the upper table portion as the patient is transferred from the bed to the device.

The dimensions of patient lift and transfer device 10 may vary considerably depending upon the application. For example, a pediatric device will be considerably smaller than a device adapted for an average adult. The following approximate dimensions are deemed exemplary: base 12 is generally 88"×34"×9"; wheels 22 are 6" in diameter; support columns 14 are 2"×5" in cross-section and extend 44" above base 12; sleeves 24 are 9" tall; slide frames 30 are 33" long with a 4" high track; carriages 32 are 33"×10"×2.5"; upper and lower plates 38, 46 are 33"×79" and their corrugations form a thickness of 0.75".

The present invention enables caregivers to easily, safely and comfortably move prostrate patients between a wider variety of beds, tables and other support surfaces, and is very intuitive to use and may be operated by nursing staff having ordinary skills, without significant operator training. The ability to load patients from either side of the device imparts additional flexibility in deployment. The clearance space provided by separation of the upper and lower table portions also significantly allows the proper cleaning and disinfecting of the belt surfaces in case of contamination by patient fluids. The device can further be easily adapted for particular uses, e.g., by mounting IV bag supports on the base or providing storage compartments in the base.

Although the invention has been described with reference to specific embodiments, this description is not meant to be construed in a limiting sense. Various modifications of the disclosed embodiments, as well as alternative embodiments of the invention, will become apparent to persons skilled in the art upon reference to the description of the invention. It is therefore contemplated that such modifications can be made without departing from the spirit or scope of the present invention as defined in the appended claims.

What is claimed is:

1. A patient lift and transfer device comprising:

a base having a plurality of wheels;

a first support column attached to said base at a first end thereof;

a second support column attached to said base at a second end thereof;

a first slide frame attached to said first support column;

a second slide frame attached to said second support column;

a first carriage slidably supported by said first slide frame, movable between a first extended position to a first side of said base, and a home position centered over said base;

a second carriage slidably supported by said second slide frame, movable between a first extended position to the first side of said base, and a home position centered over said base;

a lower table fixed at a first end to said first carriage and fixed at a second end to said second carriage, said lower table including a lower plate member surrounded by a lower belt; and an upper table coupled to said lower table, said upper table including an upper plate member surrounded by an upper belt and being movable between a lowered position and a raised position when said carriages are in the first extended positions, wherein said upper belt is in forcible contact with said lower belt when said upper table is in said lowered position, and said upper belt has slack when said upper table is in said raised position.

2. The patient lift and transfer device of claim 1 wherein:

said upper table and said lower table have a common lengthwise axis when said upper table is in either the downward position or the upward position; and said lower and upper tables have left and right sides, and a leading edge of each side of said lower and upper tables is symmetric along the common lengthwise axis of said lower and upper tables.

3. The patient lift and transfer device of claim 1 wherein a pad positioned on an upper surface of said upper plate member; and a fabric-reinforced polytetrafluoroethylene sheet interposed between said pad and a top leg of said upper belt.

4. The patient lift and transfer device of claim 1 wherein:

outside surfaces of said upper and lower belts each have a coating of ethyl vinyl acetate; and inside surfaces of said upper and lower belts each have a coating of polytetrafluoroethylene.

5. The patient lift and transfer device of claim 1 wherein the upper belt has a width which extends substantially the full length of the upper table.

6. The patient lift and transfer device of claim 1 wherein said lower belt drives said upper belt when said upper and lower belts are in forcible contact as said carriages move from the home position to the first extended position.

7. The patient lift and transfer device of claim 6, further comprising a drive mechanism for driving the lower belt, said drive mechanism being located outside of said lower table.

8. The patient lift and transfer device of claim 1 wherein said first slide frame is fixed to an adjustable upper portion of said first support column, and said second slide frame is fixed to an adjustable upper portion of said second support column.

9. The patient lift and transfer device of claim 1 wherein:

said first carriage is further movable to a second extended position at a second side of said base;

said second carriage is further movable to a second extended position to the second side of said base; and said upper table is further movable between the lowered position and the raised position when said carriages are in the second extended positions.

* * * * *